US005934801A

United States Patent [19]

List et al.

[11] Patent Number: 5,934,801

[45] Date of Patent: Aug. 10, 1999

[54] MIXING AND KNEADING APPARATUS

[75] Inventors: Jörg List, Pratteln; Walther Schwenk, Kaiseraugst; Alfred Kunz, Witterswil, all of Switzerland

[73] Assignee: List AG, Switzerland

[21] Appl. No.: 08/860,963

[22] PCT Filed: Jan. 18, 1996

[86] PCT No.: PCT/EP96/00189

§ 371 Date: Jul. 15, 1997

§ 102(e) Date: Jul. 15, 1997

[87] PCT Pub. No.: WO96/22156

PCT Pub. Date: Jul. 25, 1996

[30] Foreign Application Priority Data

Jan. 18, 1995 [CH] Switzerland ..... 136/95

[51] Int. Cl.[6] ..... B01F 7/04

[52] U.S. Cl. ..... 366/99; 366/309; 366/307; 366/304; 366/313

[58] Field of Search ..... 366/99, 309, 315, 366/312, 311, 303, 279, 307, 304, 301, 302, 313

[56] References Cited

U.S. PATENT DOCUMENTS

| | | | |
|---|---|---|---|
| 3,687,422 | 8/1972 | List | 366/309 |
| 3,689,035 | 9/1972 | List | 366/309 |
| 3,880,407 | 4/1975 | List | 366/309 |
| 4,650,338 | 3/1987 | List et al. | 366/97 |
| 4,775,243 | 10/1988 | Baumgartner | 366/313 |
| 4,824,257 | 4/1989 | List | 366/313 |
| 4,826,324 | 5/1989 | Kunz et al. | 366/309 |
| 4,889,431 | 12/1989 | Liechti | 366/309 |
| 4,941,130 | 7/1990 | List et al. | 366/309 |
| 4,950,081 | 8/1990 | List | 366/313 |
| 5,147,135 | 9/1992 | List et al. | 366/99 |
| 5,407,266 | 4/1995 | Dotsch et al. | 366/97 |

FOREIGN PATENT DOCUMENTS

| | | |
|---|---|---|
| 0220575 | 5/1987 | European Pat. Off. . |
| 0289647 | 11/1988 | European Pat. Off. . |
| 0451747 | 10/1991 | European Pat. Off. . |
| 2349106 | 5/1974 | Germany . |
| 3635877 | 10/1987 | Germany . |
| 793456 | 4/1958 | United Kingdom . |

*Primary Examiner*—Tony G. Soohoo
*Attorney, Agent, or Firm*—Bachman & LaPointe, P.C.

[57] ABSTRACT

In the case of a mixing and kneading apparatus for the, in particular, thermal treatment of products in the liquid, pasty and/or pulverulent state, with or without the supply and discharge of gases and vapors, in a housing (1), a shaft (2) rotating in said housing and having disk segments (3) or similar disc-like elements arranged on it, which segments or elements interact with mating kneading elements (7) fixed on the housing, the intention is to form, between the mating kneading elements (7), and between the mating kneading elements and the disk segments, an open space (12) in which a mixing arm (14) engages from the shaft (2). In this case, mixing arms (14) of different configurations engage in the open space (toric space 12) from the shaft (2).

11 Claims, 2 Drawing Sheets

MIXING AND KNEADING APPARATUS

The invention relates to a mixing and kneading apparatus for the, in particular, thermal treatment of products in the liquid, pasty and/or pulverulent state, with or without the supply and discharge of gases and vapors, in a housing, a shaft rotating in said housing and having disk segments or similar disc-like elements arranged on it, which segments or elements interact with mating kneading elements fixed on the housing, there being formed between the mating kneading elements, and between the mating kneading elements and the disk segments, an open space in which a mixing arm engages from the shaft.

Such mixing and kneading apparatuses are known, for example, from German Patent Specification 23 49 106 or from U.S. Pat. No. 3,678,422. The arrangement shown therein ensures a very good mixing and kneading action. Furthermore, encrustations of product on, in particular, heated elements of the apparatus, for example shaft, housing wall, disk segments and the like, are avoided effectively. However, in the case of certain products, in particular in the case of viscous pasty products, a torus of product forms in those regions between two disk segments in which there is no product treatment by a mating kneading element and, in the worst-case scenario, it is possible for this torus of product to remain in these regions, in which case it is not kneaded any further. In order to avoid this, it is expedient to use a mixer arm which is fastened on the shaft and engages in the toric space. As a result, the formation of a dead space in which the product does not undergo any treatment is avoided.

The object of the present invention is to make additional improvements to the mixing and kneading action in the toric space.

This object is achieved in that mixing arms of different configurations engage in the open space (toric space) from the shaft.

The different configurations of the mixing arms should be such that the entire toric space is worked by means of relatively narrow mixing arms. That is to say non-worked spaces within the toric space are avoided, as a result of which the mixing and kneading action is considerably improved. The distribution of the product is more uniform as a result since there are more elements which move the product. This also improves the mixing action. Furthermore, the situation where mixing arms only ever move on one pre-determined path, in which case the shaft is subjected to considerable force-absorbing peaks if, for example, a torus collapses, is avoided. The different configurations of the mixing arms mean that the product is distributed uniformly in the machine, with result that the absorption of force by the shaft is balanced out.

Each mixing arm preferably comprises a stem and a crossbar. In one exemplary embodiment of the invention, the idea is that the crossbar should always be of the same configuration, while the stem has a different length.

In contrast, in the case of another exemplary embodiment, it is also possible for the stem to have the same length, and to project approximately into the center of the toric space, but for the crossbar of mixing arms within an annular toric space to be of different configurations. Said crossbar may be set obliquely, turned round, curved, twisted, Z-shaped or S-shaped or the like. There are a large number of configurations which are intended to be covered by the invention.

In order that the mixing arm can move through the product better, it should be configured like a plowshare in cross section. There are a number of variations in this case too, and these depend on the product which is to be worked.

Further advantages, features and details of the invention can be gathered from the following description of preferred exemplary embodiments and with reference to the drawing in which.

Figure 1:
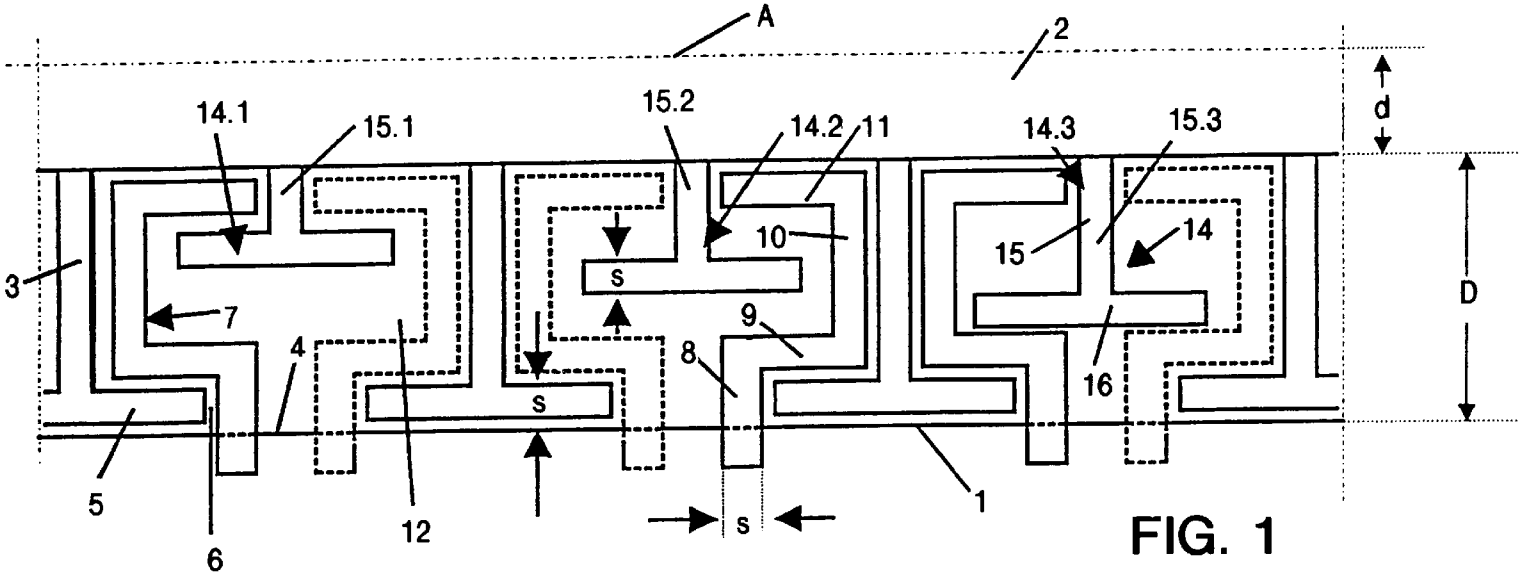
FIG. 1 shows a longitudinal section through part of a kneading and mixing apparatus according to the invention.

FIG. 1 shows a drum-like housing 1 of a mixing and kneading apparatus, a shaft 2 rotating in said housing. Spaced-apart disk segments 3 are arranged on the said shaft 2 and bear a kneading bar 5 in the vicinity of an inner wall 4 of the housing 1.

When the shaft 2 rotates in the direction z (see FIG. 2), the kneading bars 5 pass through kneading gaps 6 which are formed, in conjunction with the inner wall 4, by mating kneading elements 7. In the present exemplary embodiment, the mating kneading elements 7 are of C-shaped design. They are fixed on the housing 1 via a foot 8. Adjoining the foot 8, a kneading arm 9 runs approximately parallel to the inner wall 4, in the direction of the longitudinal axis A of the housing 1. Together with the inner wall 4, this kneading arm 9 forms the kneading gap 6. The kneading arm 9 is adjoined by a scraping arm 10, which runs approximately radially with respect to the shaft 2, in the vicinity of the disk segment 3. In the vicinity of the shaft 2, said scraping arm 10 merges into a shaft arm 11 which, in turn, runs approximately parallel to the shaft 2 and in axis-parallel manner with respect to the longitudinal axis A, in the opposite direction to the kneading arm 9. The scraping arm 10 and shaft arm 11 essentially have the task of preventing encrustations of product on the disk segments 3 and the shaft 2, since these two elements of a kneading and mixing apparatus are usually heated. The kneading bar 5 also has this task in relation to the inner wall 4, the kneading bar 5 additionally performing the task of kneading the product in the kneading gaps 6.

There are usually a plurality of mating kneading elements 7, but at least two of such elements, distributed in an annular space formed by two disk segments 3. In this case, the mating kneading elements 7 alternate in direction, as is illustrated by dashed lines in FIG. 1. Together, however, they form a toric space 12, which is largely filled with the product which is to be treated.

However, in order that the product is likewise mixed and kneaded in a suitable manner in this toric space 12, mixer arms 14 project into said toric space 12. In FIG. 1 the mixing arms are designed as T-fingers, each comprising a stem 15 and a crossbar 16.

Figure 2:
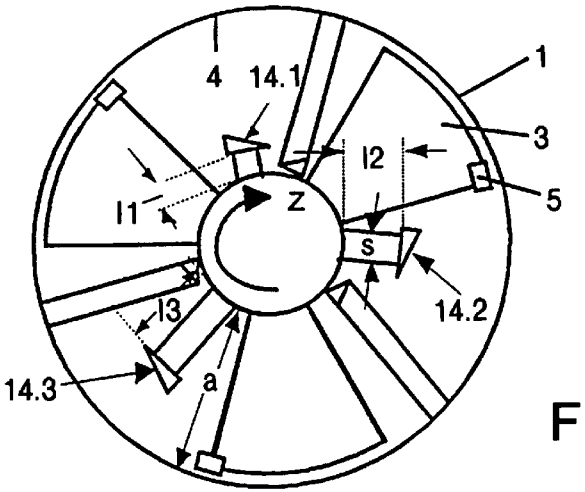
FIG. 2 shows a cross section through the kneading and mixing apparatus according to FIG. 1.

In the case of the exemplary embodiment according to FIGS. 1 and 2, the invention provides that the crossbar 16 is always of the same design, but the stem 15.1, 15.2 and 15.3 for different mixing arms 14.1, 14.2 and 14.3 within an annular toric space 12 has a different length $l_1$, $l_2$ and $l_3$. This makes it possible to work the entire toric space 12 during a revolution of the shaft 2, with result that, within the toric space 12, there are no dead zones in which the product could possibly remain. This means that the product is always kept on the move, encrustations of product are reduced and the kneading action is considerably improved. Furthermore, there is a reduction in force-absorbing peaks during rotation of the shaft 2, since the product is always worked by at least two mixing arms 14. It is not possible for the following mixing arm to move through the product in the same track as that produced by the preceding mixing arm.

Such an arrangement of relatively narrow elements which project into the toric space to different extents is particularly expedient in mixing and kneading apparatuses whose internal dimensions are at a specific ratio with respect to one another. The important parameter for this purpose is the distance a of the shaft 2 from the inner wall 4 of the housing 1, this being formed from half of a diameter d of the shaft 2 and of an internal diameter D of the housing 1. This distance a should be greater than 5S, where S may be the width of the foot 8, of the stem 15, of the crossbar 16, of the kneading bar 5 or the like. It is only when the distance a is above 5S that the arrangement of different mixing arms is usually appropriate.

FIGS. 1 and 2 only show one exemplary embodiment of such different mixing arms. Further exemplary embodiments are shown in FIGS. 3 to 6, although the invention is not intended to be restricted to these exemplary embodiments either. For the sake of simplicity, FIGS. 3 to 6 show a toric space 12 as always being formed by two mating kneading elements 7.1 and 7.2 which are arranged opposite one another, although in practice these elements are merely offset with respect to one another.

Figure 5:
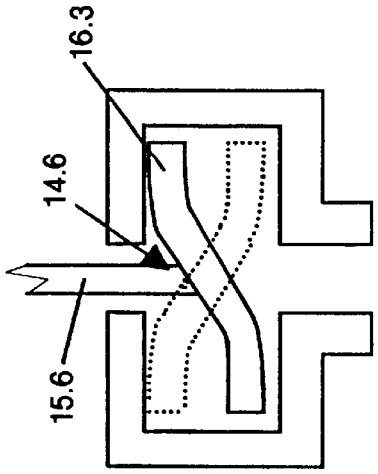
FIGS. 3 to 6 show plan views of different exemplary embodiments of mixing arms in a toric space formed by two mating kneading elements.
Figure 4:
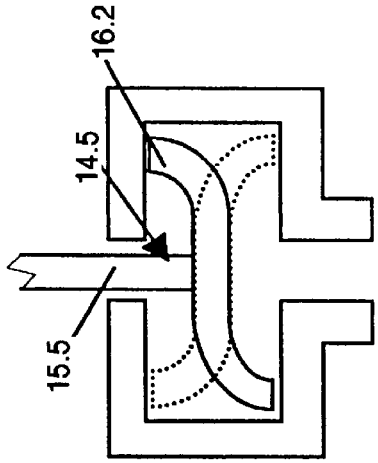
Figure 3:
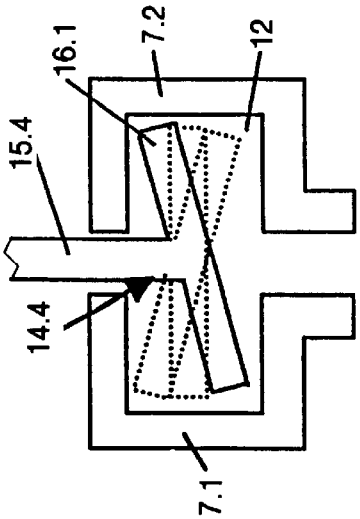

According to FIGS. 3 to 5, the stem 15.4, 15.5 and 15.6 always has the same length, with the result that it terminates approximately in the center of the toric space 12. It is indicated in FIG. 3 that the crossbar 16.1 need not run, as is illustrated in FIG. 1, in an axis-parallel manner, but rather may be arranged in an inclined manner with respect to the longitudinal axis A. Within an annular toric space, it is then possible for different crossbars shown to alternate with crossbars which also run in an axis-parallel manner.

However, it is also possible, as is shown in FIGS. 4 and 5, for the crossbars 16.2, 16.3 to be bent in a wave-shaped or S-shaped manner. C-shaped crossbars or those which run in a zigzag fashion are also conceivable. The shape of the crossbars depends in each case on the product which is to be treated.

Figure 6:
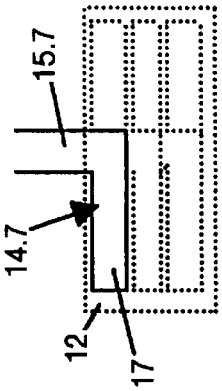

In FIG. 6, the toric space 12 is only indicated by dashed lines. A finger-like mixing arm 14.7 engages in it, and the transverse finger 17 of said mixing arm alternates its orientation to the left and right, and the stem 15.7 of said mixing arm has a different length.

Figure 8:
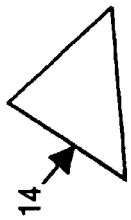
FIGS. 7 to 9 show cross sections through different exemplary embodiments of mixing arms.

As far as treating all the product in the toric space 12 is concerned, the cross section of the elements which move through the product also seems to be important. These elements include, in particular, the mixing arm 14, but also the kneading bar 5, an edge of the disk segment 3, and the mating kneading element 7. The cross section is preferably designed like a plowshare, it being possible for this to have a straightforward triangular cross section according to FIG. 8.

Figure 7:
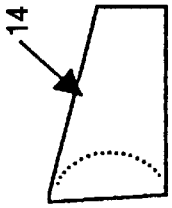

However, in order better to form a discharge surface, the cross section is of a desk-like design according to FIG. 7, it being possible for one side also to be grooved, as indicated by dashed lines. This improves discharge of the product.

Figure 9:
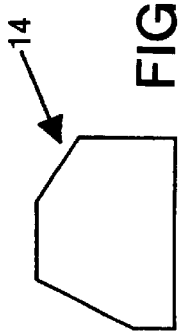

In the case of products which have a pronounced tendency to form crusts, a cross section according to FIG. 9 is preferred, this cross section resulting in a high displacement capacity and thus in good product movement.

We claim:

1. Mixing and kneading apparatus, which comprises: a housing; a shaft rotating in said housing and having similar disc-like elements arranged on said shaft; mating kneading elements fixed on said housing; wherein said disc-like elements interact with said mating kneading elements; an open toric space formed between the mating kneading elements and between the mating kneading elements and the disc-like elements; a plurality of mixing arms extending from the shaft which engage said open space; wherein the mixing arms following one after the other around the shaft are configured such that they work essentially the entire axial cross section of the open toric space.

2. Mixing and kneading apparatus according to claim 1, wherein said disc-like elements are disc segments.

3. Mixing and kneading apparatus according to claim 1, wherein said open space is an annular space.

4. Mixing and kneading apparatus according to claim 1, wherein said mixing arms include a stem and a crossbar.

5. Mixing and kneading apparatus according to claim 4, wherein within said open space at least some stems have different lengths than other stems.

6. Mixing and kneading apparatus according to claim 4, wherein within said open space at least some crossbars have different lengths than other crossbars.

7. Mixing and kneading apparatus according to claim 4, wherein the crossbars of the mixing arms within said open space are at least one of set obliquely, curved and twisted in relation to a longitudinal axis of the housing.

8. Mixing and kneading apparatus according to claim 4, wherein at least one of the stem and the crossbar are designed like a plowshare in cross section.

9. Mixing and kneading apparatus according to claim 4, wherein the housing has an inner wall and the kneading elements have a width, wherein the distance of the shaft from the inner wall of the housing is greater than five times the width of the kneading elements.

10. Mixing and kneading apparatus according to claim 4, wherein mating kneading elements are arranged opposite each other.

11. Mixing and kneading apparatus according to claim 4, wherein the stem terminates approximately in the center of the open space.

* * * * *